US011732975B2

(12) United States Patent
Yoon et al.

(10) Patent No.: US 11,732,975 B2
(45) Date of Patent: Aug. 22, 2023

(54) HEAT EXCHANGERS AND RELATED SYSTEMS AND METHODS

(71) Applicant: Battelle Energy Alliance, LLC, Idaho Falls, ID (US)

(72) Inventors: SuJong Yoon, Idaho Falls, ID (US); James E. O'Brien, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 24 days.

(21) Appl. No.: 17/447,661

(22) Filed: Sep. 14, 2021

(65) Prior Publication Data

US 2022/0082334 A1 Mar. 17, 2022

Related U.S. Application Data

(60) Provisional application No. 63/078,437, filed on Sep. 15, 2020.

(51) Int. Cl.
*F28D 15/04* (2006.01)
*F28F 9/02* (2006.01)

(52) U.S. Cl.
CPC ..... *F28D 15/04* (2013.01); *F28F 9/02* (2013.01)

(58) Field of Classification Search
CPC ..... F28D 15/0275; F28D 7/10; F28D 7/12; F28D 7/103; F28D 7/16; F28D 7/106; F28D 2015/0225; F28F 2210/02
See application file for complete search history.

(56) References Cited

U.S. PATENT DOCUMENTS 3,868,994 A * 3/1975 Petrek ..... F22B 1/063 165/142
4,426,959 A * 1/1984 McCurley ..... F28D 15/0275 285/47
4,440,217 A * 4/1984 Stieler ..... F28D 7/103 165/145
4,585,053 A 4/1986 Kaufman et al.
5,076,469 A 12/1991 Pleuse et al.
(Continued)

FOREIGN PATENT DOCUMENTS

EP 1078376 B1 11/2007
GB 1078643 A 8/1967
WO 2012/075010 A1 6/2012

*Primary Examiner* — Tho V Duong
(74) *Attorney, Agent, or Firm* — TraskBritt

(57) ABSTRACT

A heat exchanger may include a main body with an inlet plenum and an outlet plenum at a first end, and a header at a second end. At least one elongated shaft may extend from the outlet plenum to the header. At least one heat pipe may be coupled to the header and a portion of each heat pipe may be positioned within a corresponding elongated shaft defining an annular space between each heat pipe and each corresponding elongated shaft. A flow skirt may include a manifold located between the inlet plenum and the outlet plenum of the main body. At least one elongated tube may extend from the manifold. Each elongated tube may be positioned within a corresponding annular space between each heat pipe and each corresponding elongated shaft, dividing the annular space into two concentric annular channels comprising an inner annular channel and an outer annular channel.

15 Claims, 11 Drawing Sheets

(56) References Cited

U.S. PATENT DOCUMENTS

| | | | | |
|---|---|---|---|---|
| 6,001,306 | A * | 12/1999 | McFall | F28D 7/103 422/46 |
| 6,220,344 | B1 * | 4/2001 | Beykirch | F28D 7/026 165/169 |
| 2006/0210468 | A1 * | 9/2006 | Veenstra | F28D 7/103 422/651 |
| 2015/0338171 | A1 | 11/2015 | Mishkinis et al. | |

* cited by examiner

HEAT EXCHANGERS AND RELATED SYSTEMS AND METHODS

CROSS-REFERENCE TO RELATED APPLICATION

This application claims the benefit under 35 U.S.C. § 119(e) of U.S. Provisional Patent Application Ser. No. 63/078,437, filed Sep. 15, 2020, the disclosure of which is hereby incorporated herein in its entirety by this reference.

GOVERNMENT RIGHTS

This invention was made with government support under Contract No DE-AC07-05-ID14517 awarded by the United States Department of Energy. The government has certain rights in the invention.

TECHNICAL FIELD

The disclosure, in various embodiments, relates generally to heat exchangers and related methods and systems. In some embodiments, the disclosure relates to heat exchangers designed to transfer heat from the heat removal section of a heat pipe-cooled microreactor to power a system working fluid while introducing minimal thermal stresses.

BACKGROUND

Nuclear micro-reactors are currently receiving significant attention for various applications including remote commercial or residential locations, military forward operating bases, and space power. These micro-reactors can produce 1-20 MW of thermal energy. They can also be factory-fabricated and are easily transportable. Several industrial companies are developing nuclear micro-reactor concepts including Westinghouse, Holos, and others.

BRIEF SUMMARY

In some embodiments of the present disclosure, a heat exchanger may include a main body with an inlet plenum and an outlet plenum at a first end, and a header at a second end. At least one elongated shaft may extend from the outlet plenum to the header. At least one heat pipe may be coupled to the header and a portion of each heat pipe may be positioned within a corresponding elongated shaft defining an annular space between each heat pipe and each corresponding elongated shaft. A flow skirt may include a manifold located between the inlet plenum and the outlet plenum of the main body. At least one elongated tube may extend from the manifold. Each elongated tube may be positioned within a corresponding annular space between each heat pipe and each corresponding elongated shaft, therein dividing the annular space into two concentric annular channels comprising an inner annular channel and an outer annular channel.

In additional embodiments of the present disclosure, a method of transferring heat may comprise providing heat into at least one elongated shaft in a main body of a heat exchanger with at least one heat pipe via a first working fluid within the at least one heat pipe. The method may further comprise directing a second working fluid through an inner annular channel located between the at least one heat pipe and at least one tube extending between the at least one heat pipe and the at least one elongated shaft. The second working fluid may then be directed around a free end of the at least one tube and into an outer annular channel located between the at least one tube and the at least one elongated shaft.

In yet additional embodiments of the present disclosure, a power system may comprise a heat exchanger, a heat source, and a power generator. The heat exchanger may include a main body with an inlet plenum and an outlet plenum at a first end, and a header at a second end. At least one elongated shaft may extend from the outlet plenum to the header. At least one heat pipe may be coupled to the header and a portion of each heat pipe may be positioned within a corresponding elongated shaft defining an annular space between each heat pipe and each corresponding elongated shaft. A flow skirt may include a manifold located between the inlet plenum and the outlet plenum of the main body. At least one elongated tube may extend from the manifold. Each elongated tube may be positioned within a corresponding annular space between each heat pipe and each corresponding elongated shaft, therein dividing the annular space into two concentric annular channels comprising an inner annular channel and an outer annular channel. The heat source may be configured to deliver heat to the at least one heat pipe of the heat exchanger. The power generator may be fluidly coupled to an outlet of the heat exchanger and configured to convert heat from the heat exchanger into work.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

Figure 1:
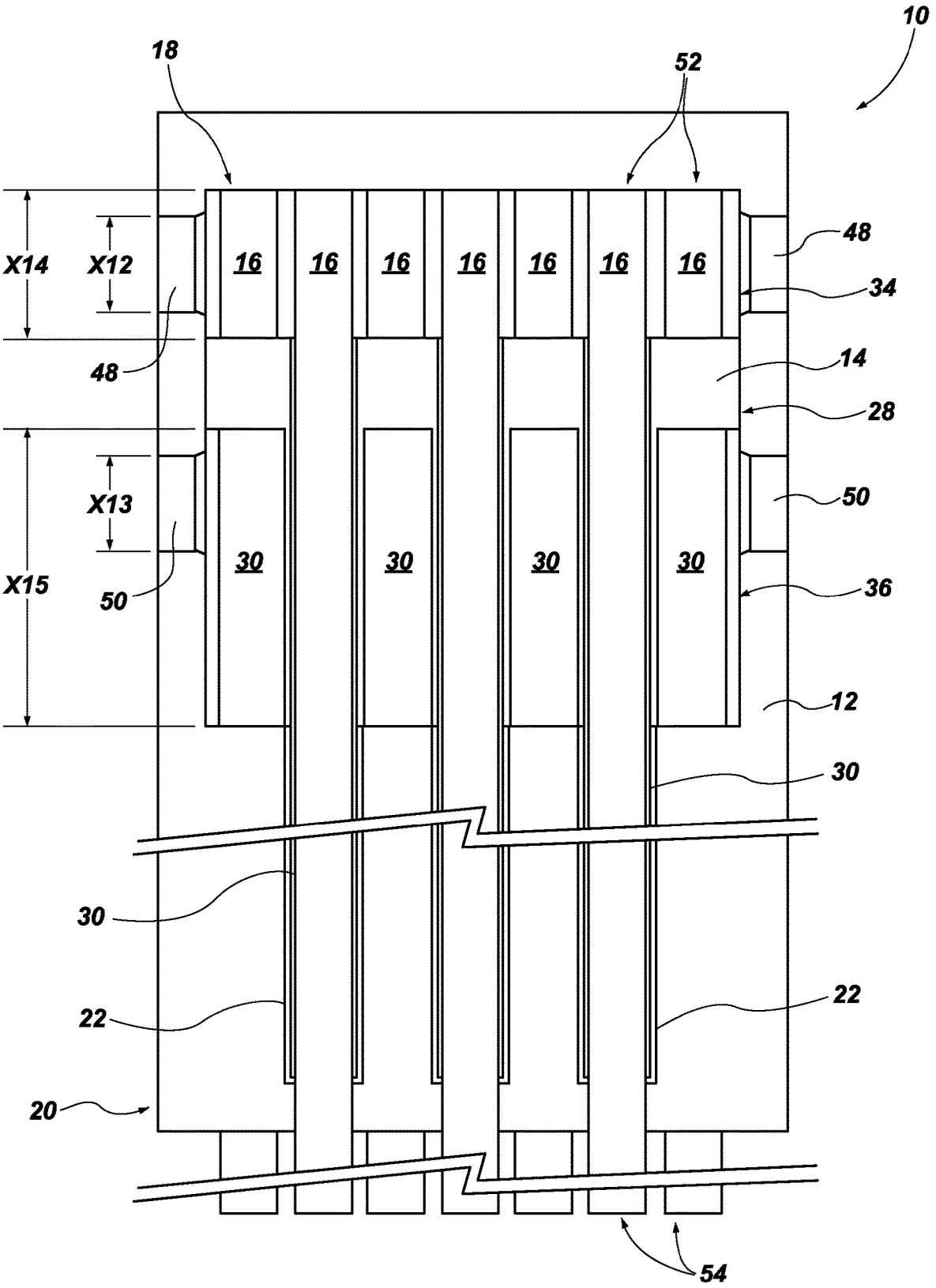
FIG. 1 illustrates a partial cross-sectional view of a heat exchanger according to an embodiment of the present disclosure.

In the following detailed description, reference is made to the accompanying drawings, which form a part hereof, and in which are shown, by way of illustration, specific examples of embodiments in which the present disclosure may be practiced. These embodiments are described in sufficient detail to enable a person of ordinary skill in the art to practice the present disclosure. However, other embodiments enabled herein may be utilized, and structural, material, and process changes may be made without departing from the scope of the disclosure.

The illustrations presented herein are not necessarily meant to be actual views of any particular method, system, device, or structure, but are merely idealized representations that are employed to describe the embodiments of the present disclosure. In some instances similar structures or components in the various drawings may retain the same or similar numbering for the convenience of the reader; however, the similarity in numbering does not necessarily mean that the structures or components are identical in size, composition, configuration, or any other property.

Disclosed embodiments relate to heat exchangers designed to transfer heat from the heat removal section of a heat pipe-cooled microreactor to power a system that contains a working fluid while introducing minimal thermal stresses. For example, heat exchangers in accordance with this disclosure may utilize a heat pipe to transfer heat from a core of a microreactor to the heat exchanger, and a working fluid of the heat exchanger to transfer heat from the heat pipe away from the microreactor. More specifically, evaporator ends of heat pipes in an array of heat pipes may be exposed to a heat source, such as, for example, a core of a microreactor, condenser ends of the heat pipes may be located within elongated shafts of the heat exchanger to define a flow space within the elongated shafts around the condenser ends, and a coolant (e.g., the working fluid) may be circulated in the flow space to extract heat from the condenser ends of the heat pipes. In some examples, a series of concentric flow spaces may be defined around the condenser ends of the heat pipes, enabling the coolant to flow in a first direction in a first flow space around and directly proximate to the condenser ends and to flow in a second, opposite direction in a second flow space around and directly proximate to the first flow space. In some examples, one or more flow spaces of the heat exchanger may define a tortuous flow path for coolant, or may otherwise include structures to disrupt an otherwise linear flow of coolant through the flow path.

Power systems may benefit from heat exchangers that operate at relatively high pressures and over a relatively high temperature range. There are technical issues, however, associated with the integration of nuclear thermal energy sources with certain power conversion units, such as air Brayton or supercritical $CO_2$ power cycles. Both of these cycles require heat transfer to the working fluid at high pressure. The long-term operational reliability of such nuclear micro-reactor systems is important for commercial deployment. However, the high-pressure and high-temperature operating conditions of a nuclear micro-reactor heat removal section could lead to the component failure due to significant thermal stress and fatigue. Accordingly, it would be desirable to have improved heat exchangers and related systems, such as those disclosed herein, that may operate reliably under such high-pressure and high-temperature operational conditions.

For example, heat exchangers in accordance with this disclosure, which may be referred to as "bayonet type" heat exchangers, may reduce risk of meltdown when used with microreactors because the coolant of the heat exchanger is not directly exposed to the core. Such distancing between the core and the coolant may reduce or eliminate the risk that the coolant would superheat, vaporize, and overpressurize the core, which could potentially cause a meltdown. Isolating the coolant, and other components of the heat exchanger, from the core may also reduce the risk of contamination (e.g., by exposure to radiation), enabling greater flexibility in coolant and component selection, handling, and disposal. In addition, modifying a bayonet type heat exchanger to operate in connection with one or more heat pipes may enable a single coolant material to be deployed in the flowable spaces within the heat exchanger, simplifying considerations for material selection, component maintenance, and coolant disposal.

The following description may include examples to help enable one of ordinary skill in the art to practice the disclosed embodiments. The use of the terms "exemplary," "by example," and "for example," means that the related description is explanatory, and though the scope of the disclosure is intended to encompass the examples and legal equivalents, the use of such terms is not intended to limit the scope of an embodiment or this disclosure to the specified components, steps, features, functions, or the like.

It will be readily understood that the components of the embodiments as generally described herein and illustrated in the drawings could be arranged and designed in a wide variety of different configurations. Thus, the following description of various embodiments is not intended to limit the scope of the present disclosure, but is merely representative of various embodiments. While the various aspects of the embodiments may be presented in the drawings, the drawings are not necessarily drawn to scale unless specifically indicated.

Furthermore, specific implementations shown and described are only examples and should not be construed as the only way to implement the present disclosure unless specified otherwise herein. For the most part, details concerning timing considerations and the like have been omitted where such details are not necessary to obtain a complete understanding of the present disclosure and are within the abilities of persons of ordinary skill in the relevant art.

Any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. In addition, unless stated otherwise, a set of elements may comprise one or more elements.

As used herein, the term "substantially" in reference to a given parameter, property, or condition means and includes to a degree that one of ordinary skill in the art would understand that the given parameter, property, or condition is met with a small degree of variance, such as, for example, within acceptable manufacturing tolerances. By way of example, depending on the particular parameter, property, or condition that is substantially met, the parameter, property, or condition may be at least 90% met, at least 95% met, or even at least 99% met.

FIG. 1 illustrates a partial cross-sectional view of a heat exchanger 10 according to an embodiment of the present disclosure. The heat exchanger 10 includes a main body 12, a flow skirt 14, and a plurality of heat pipes 16. In some embodiments, the heat exchanger 10 may be configured generally as a bayonet type heat exchanger.

Figure 2A:
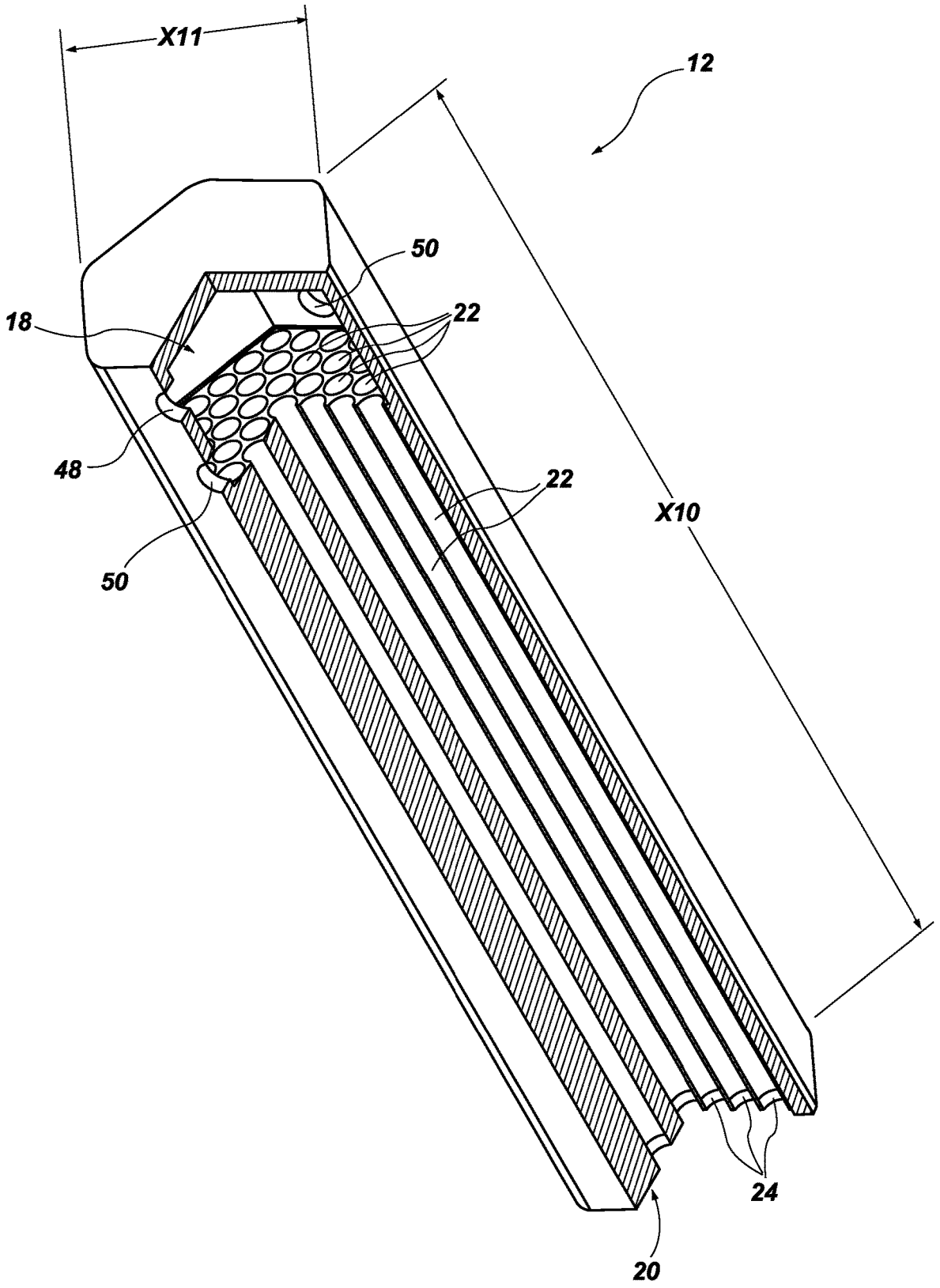
FIG. 2A illustrates a partial cross-sectional view of a main body of the heat exchanger of FIG. 1.

FIG. 2A illustrates the main body 12 of the heat exchanger 10 of FIG. 1. The main body 12 may have an elongated shape with a plenum 18 located at a first end and a header 20 located at an opposing second end. A plurality of elongated shafts 22 extend through main body 12 from the plenum 18 to the header 20. The plenum 18 may define an open volume that extends over an opening at the end of each elongated shaft 22. The header 20 may include openings 24 positioned at the end of each elongated shaft 22, the openings 24 having a diameter smaller than a diameter of the elongated shafts 22. Each of the openings 24 in the header 20 may be sized and configured to receive a heat pipe 16 (see FIG. 1) therethrough.

A material of the main body 12 may be configured for use in industrial applications. For example, the main body 12 may include metals, metal alloys, ceramics, polymers, and/or composite materials including the foregoing (e.g., ceramic-metallic composite materials). As a specific, non-limiting example, the main body 12 may be comprised of a stainless steel alloy.

Figure 2B:
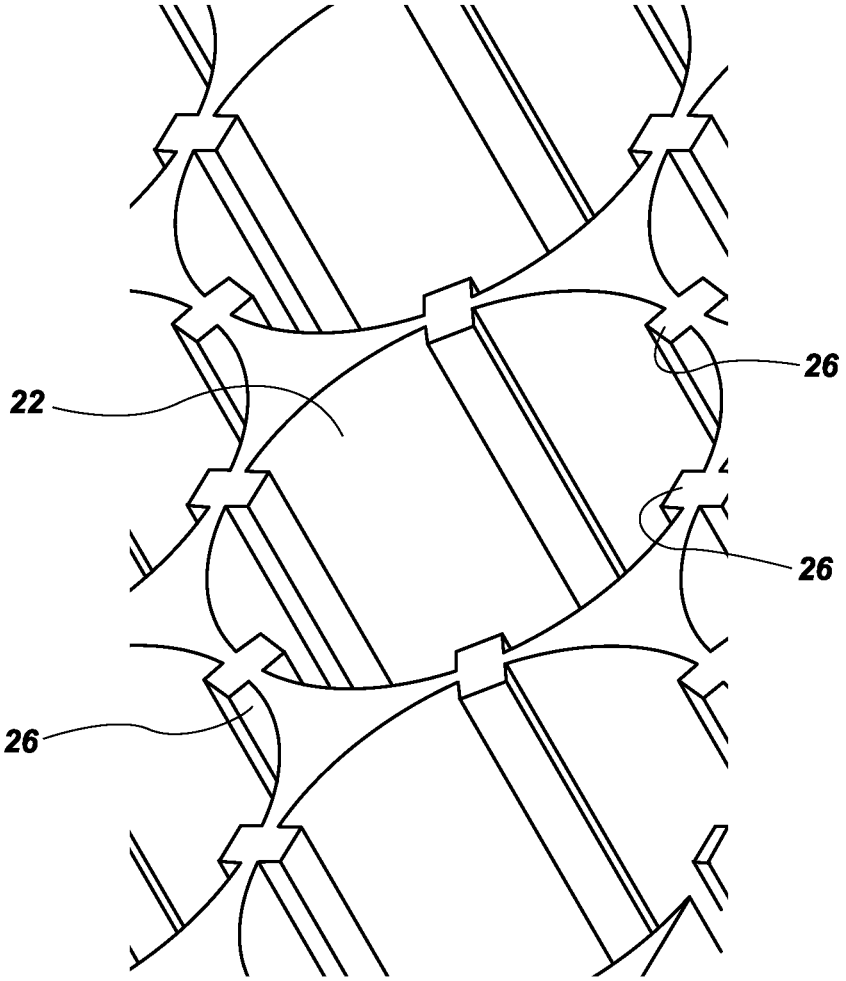
FIG. 2B illustrates a detail isometric view of the main body of FIG. 2A.

As shown in an isometric detail view of a portion of the main body 12 in FIG. 2B, each of the elongated shafts 22 of the main body 12 may optionally include alignment features on a surface thereof, such as pins 26 extending along a length of an inner surface of each elongated shaft 22, which will be discussed in further detail below. For example, the pins 26 may be configured as protrusions extending radially inward from an otherwise at least substantially cylindrical inner surface of a given elongated shaft 22. In some examples, the pins 26 may extend continuously from end to end along the length of a given elongated shaft 22, and the pins 26 may be discontinuous, only appearing in certain locations along the length of a given elongated shaft 22 in other examples. The pins 26 disclosed herein may alternately be referred to as, for example, "fins," "ribs," "spines," "shims," "spacers," or the like.

Figure 3:
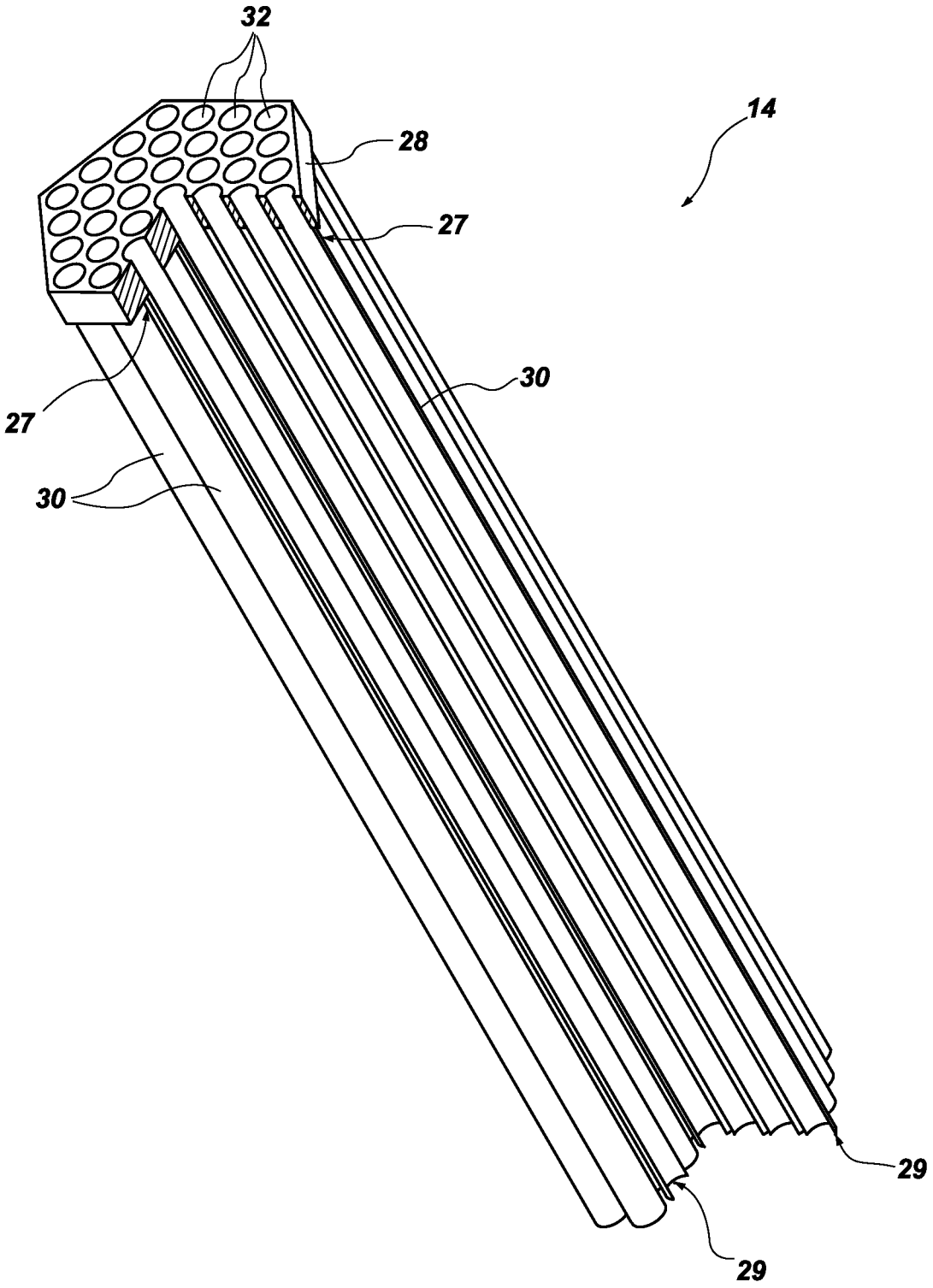
FIG. 3 illustrates a partial cross-sectional view of a flow skirt of the heat exchanger of FIG. 1.

FIG. 3 illustrates the flow skirt 14 of the heat exchanger 10 of FIG. 1. The flow skirt 14 may include a manifold 28 at a first end, and a plurality of elongated tubes 30 extending from the manifold 28. A first end 27 of each elongated tube 30 may be joined to the manifold 28 at a corresponding opening 32 through the manifold 28. Each elongated tube 30 may have a free end 29 thereof, located opposite the first end 27, sized and configured with an outer dimension (e.g., an outer diameter) that is smaller than a corresponding dimension (e.g., a width or bore diameter) of an elongated shaft 22 in the main body 12. Accordingly, the free ends 29 of the elongated tubes 30 may be sized and configured to be positioned within the elongated shafts 22 of the main body 12.

Referring again to FIG. 1, the manifold 28 of the flow skirt 14 may be located within the plenum 18 of the main body and may divide the plenum 18 to define an inlet plenum 34 and an outlet plenum 36. For example, the manifold 28 may be joined with a wall of the main body 12 to separate the inlet plenum 34 and the outlet plenum 36.

Additionally, each elongated tube 30 may have a free end thereof sized and configured with an inner dimension (e.g., an inner diameter) that is larger than a corresponding dimension (e.g., a width or outer diameter) of a heat pipe 16. Accordingly, the heat pipes 16 may extend through the header 20 of the main body 12 and into each of the elongated tubes 30 of the flow skirt 14. Each of the elongated tubes 30 of the flow skirt 14 may optionally include features on an outer surface and/or an inner surface, such as pins 26 extending along a length of an inner surface of each elongated tube 30, which will be discussed in further detail below. As a non-limiting example, the flow skirt 14 may be comprised of the same materials discussed previously in connection with the main body 12 (e.g., a stainless steel alloy), though the material of the flow skirt 14 need not be the same as the material of the main body 12. For example, the flow skirt 14 may be made of a different material than the main body 12, and the flow skirt 14 and main body 12 may be joined together after the initial manufacturing of each separately. In yet further examples, the main body 12 and the flow skirt 14 may be a monolithic structure that is manufactured substantially simultaneously, such as by additive manufacturing.

Figure 4A:
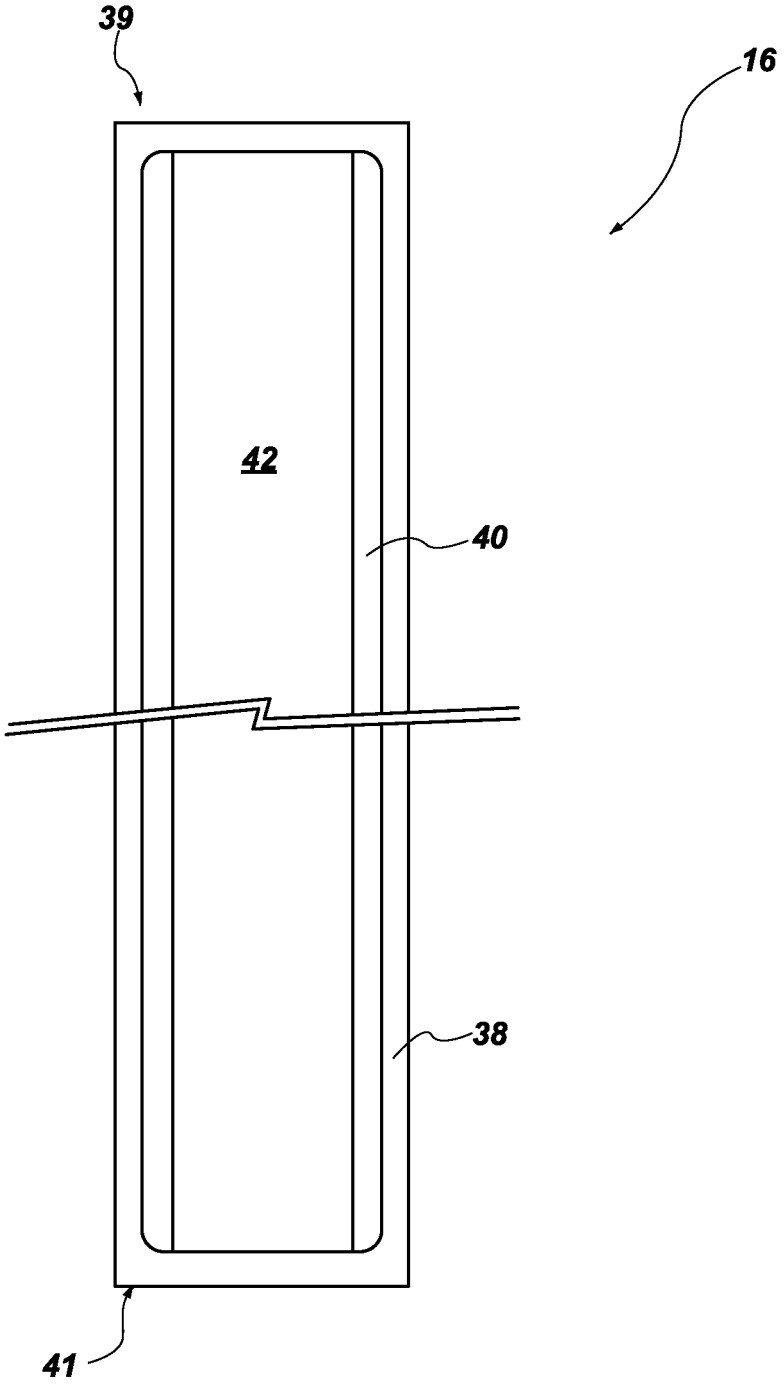
FIG. 4A illustrates a cross-sectional view of a heat pipe of the heat exchanger of FIG. 1.

FIG. 4A illustrates a cross-sectional view of a heat pipe 16 of the heat exchanger 10 of FIG. 1. An outer shell 38 of the heat pipe 16 may be configured as an elongated pipe that is closed at each end. As a non-limiting example, the outer shell 38 may be comprised of a metal or metal alloy material (e.g., a stainless steel alloy). Within the outer shell 38, the heat pipe 16 may include a wicking material 40 that extends along the interior length of the heat pipe 16 and is located radially proximate to the outer shell 38. For example, the wicking material 40 may have an at least substantially annular shape and may line interior walls of the outer shell 38. The wicking material 40 may comprise a porous material configured to induce capillary flow of a working fluid within the heat pipe 16 from a condenser end 39 toward an evaporator end 41 of the heat pipe 16. As a non-limiting example, the wicking material 40 may be comprised of powdered nickel. The heat pipe 16 may include one or more open channels therein extending along the length of the wicking material 40. For example, the wicking material 40 may be generally annular with an outer diameter that is smaller than an inner diameter of the outer shell 38 and an at least substantially cylindrical open channel 42 located radially closer to a geometric center of the heat pipe 16 than the wicking material 40 (e.g., at least substantially centered on the geometric center of the heat pipe 16 along a longitudinal axis thereof) that extends along the length of the heat pipe 16. The heat pipe 16 may additionally include a first working fluid within the outer shell 38 to facilitate heat transfer along the length of the heat pipe 16, as will be discussed in further detail below. The first working fluid may be selected and configured to evaporate and phase change to a gaseous state when exposed to operating temperatures at and proximate to the evaporator end 41, and to condense and phase change to a liquid state when exposed to operating temperatures at and proximate to the condenser end 39. As a non-limiting example, the first working fluid may be comprised of sodium.

Figure 4B:
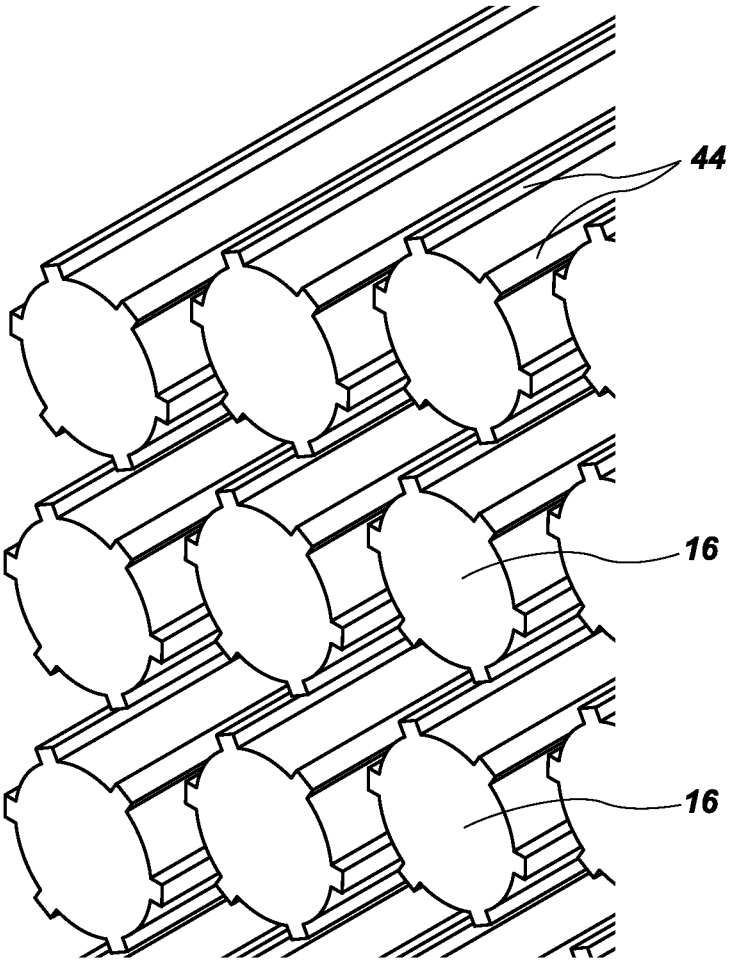
FIG. 4B illustrates a detail isometric view of heat pipes of the heat exchanger of FIG. 1.

As shown in an isometric detail view of a portion of the heat pipes 16 in FIG. 4B, each of the heat pipes 16 may optionally include features on an outer surface, such as pins 44 extending along a length of an outer surface of each heat pipe 16, which will be discussed in further detail below. For example, the pins 44 may be configured as protrusions extending radially outward from an otherwise at least substantially cylindrical outer surface of a given heat pipe 16. In some examples, the pins 44 may extend continuously from end to end along the length of a given heat pipe 16, and the pins 44 may be discontinuous, only appearing in certain locations along the length of a given heat pipe 16 in other examples. The pins 44 disclosed herein may alternately be referred to as, for example, "fins," "ribs," "spines," "shims," "spacers," or the like.

Referring again to FIG. 1, the main body 12 of the heat exchanger 10 may include one or more openings 48 to the inlet plenum 34 and each opening 48 may be configured to be coupled to a fluid source (e.g., a pipe). Likewise, the main body 12 of the heat exchanger 10 may include one or more openings 50 to the outlet plenum 36 and each opening 50 may be configured to be coupled to a fluid outlet (e.g., a pipe). Accordingly, a second working fluid, such as a pressurized gas, may be directed into the inlet plenum 34 of the heat exchanger 10 through the one or more openings 48 and the second working fluid may be directed out of the outlet plenum 36 of the heat exchanger 10 through the one or more openings 50.

The heat pipes 16 extend through the header 20 of the main body 12. A first end 52 of each heat pipe 16 may extend through a corresponding elongated shaft 22 of the main body 12. For example, the first end 52 (e.g., a condenser end) of each heat pipe 16 may be positioned within a corresponding elongated shaft 22 of the main body 12 such that a longitudinal axis of each heat pipe 16 may be at least substantially coaxially aligned with a longitudinal axis of a corresponding elongated shaft 22 of the main body 12. Each heat pipe 16 may extend from within the main body outward and away from the main body 12, such that a second end 54 (e.g., an evaporator end) of each heat pipe 16 may be located distal from the main body 12. In use, the second ends 54 of the heat pipes 16 may be positioned within or proximate to a heat source, as will be discussed further herein below. As a non-limiting example, the second ends 54 of the heat pipes 16 may be configured to be positioned within or proximate to a reactor core of a nuclear micro-reactor. Each heat pipe 16 may be coupled to and sealed to the header 20 of the main body 12. For example, each heat pipe 16 may be bonded or welded to the header 20 of the main body 12.

Figure 5:
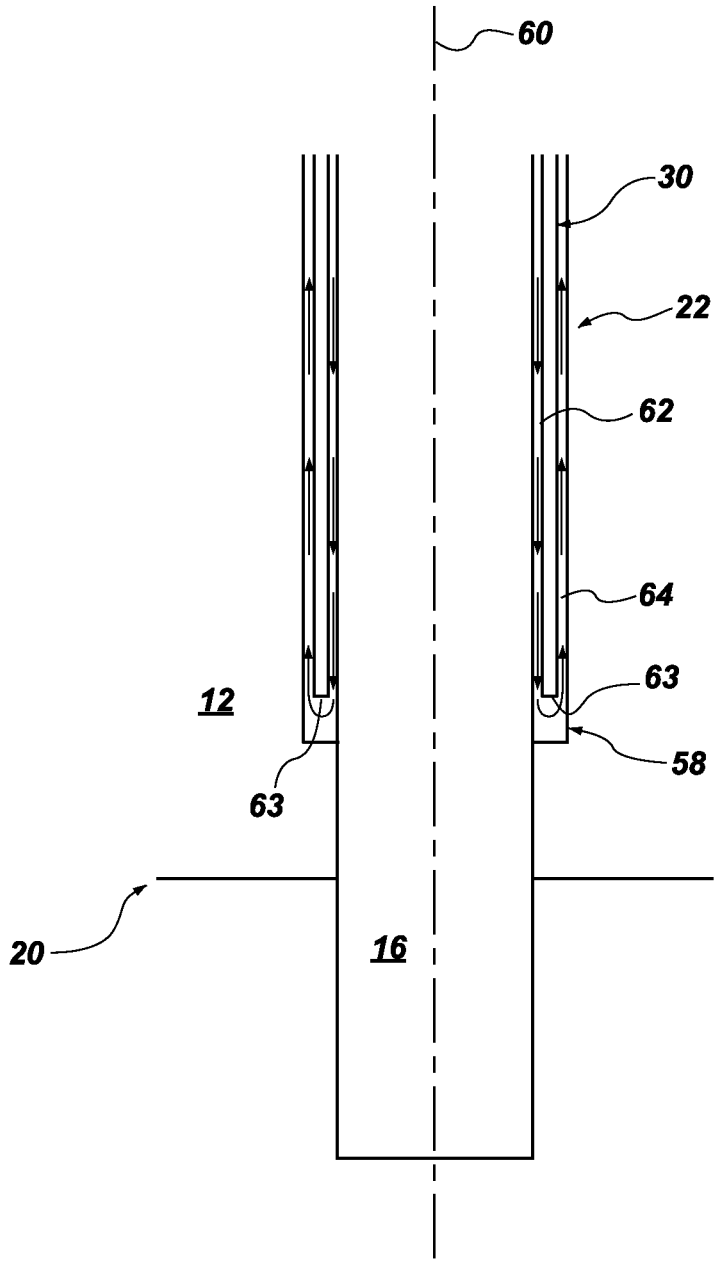
FIG. 5 illustrates a partial cross-sectional detail view of a portion of the heat exchanger of FIG. 1 at a location near a free end of an elongated tube of the flow skirt.

The elongated tubes 30 of the flow skirt 14 extend from the manifold 28 and into the elongated shafts 22 of the main body 12. As illustrated in a cross-sectional detail view in FIG. 5, the free ends 63 of each of the elongated tubes 30 are positioned in an annular space 58 in the corresponding elongated shaft 22. The outside of the annular space 58 is defined by a wall of the corresponding elongated shaft 22 and the inside of the annular space 58 is defined by the outer shell 38 of the heat pipe 16 positioned within the corresponding elongated shaft 22 of the main body 12. For example, the free end 63 of each elongated tube 30 may be positioned within a corresponding elongated shaft 22 of the main body 12 such that a longitudinal axis of each elongated tube 30 of the flow skirt 14 may be substantially coaxially aligned with the longitudinal axis of a corresponding elongated shaft 22 of the main body 12. Accordingly, each of elongated shafts 22 of the main body 12 may include therein a portion of an elongated tube 30 and a portion of a heat pipe 16, and the elongated shaft 22, the elongated tube 30, and the heat pipe 16 may all be substantially coaxially aligned along their respective longitudinal axis 60.

The free ends 63 of the elongated tubes 30 may extend into the elongated shafts 22 such that the annular space 58 between each elongated shaft 22 and corresponding heat pipe 16 may be divided into two concentric annular channels by the elongated tube 30. A space may be provided between the end of each elongated tube 30 and the bottom of the elongated shaft 22 to provide fluid communication between an inner annular channel 62 and an outer annular channel 64 of the two concentric annular channels 62, 64.

Alignment features, such as the pins 26 (see FIG. 2B) extending along the surface of the elongated shafts 22 of the main body 12, may be sized and configured to facilitate and maintain the coaxial alignment of each of the elongated tubes 30 of the flow skirt 14 with a corresponding elongated shaft 22 of the main body 12. Likewise, alignment features, such as the pins 44 (see FIG. 4B) extending along the outer surface of the heat pipes 16, may be sized and configured to facilitate and maintain the coaxial alignment of each of the heat pipes 16 with a corresponding elongated tube 30 of the flow skirt 14, and thus also facilitate and maintain the coaxial alignment of each of the heat pipes 16 with a corresponding elongated shaft 22 of the main body 12. The alignment features are sized and located to fit between the heat pipe 16 and the elongated tube 30 and/or between the elongated tube 30 and the elongated shaft 22, but it is not important which of these components of the heat exchanger these alignment features are located on, such as on a surface of the heat pipe 16, one or more surfaces of the elongated tube 30, the surface of the elongated shaft 22, and/or any combination of these locations. In some embodiments, such as shown in FIG. 6, such alignment features may be provided as one or more separate structures.

Figure 6:
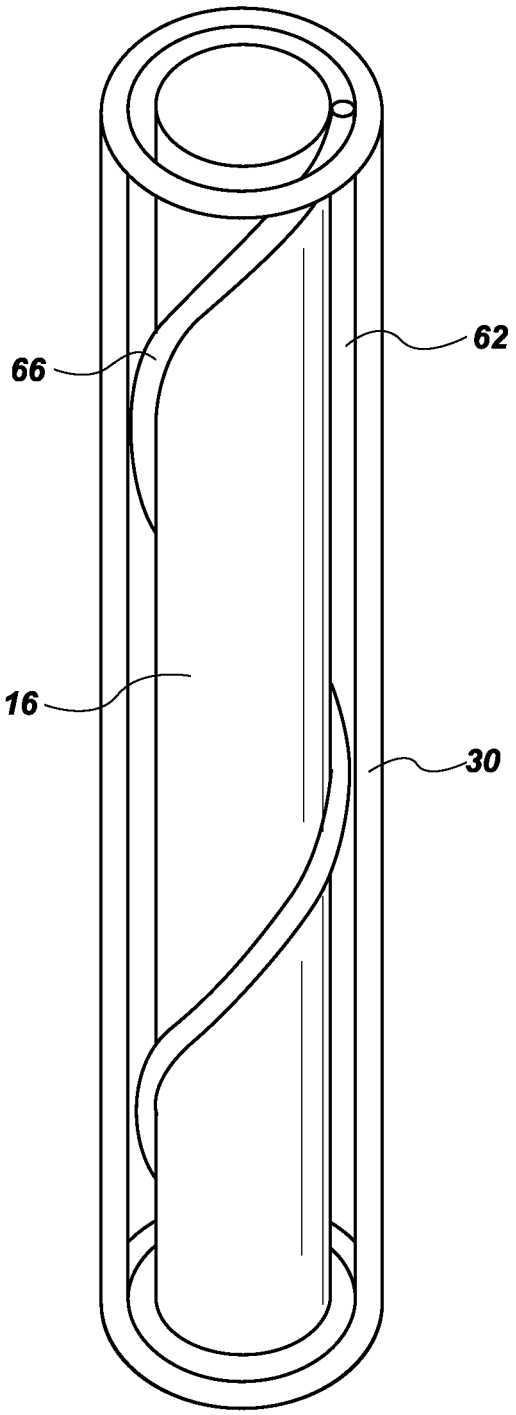
FIG. 6 illustrates a detail schematic view of an alignment feature positioned within an annular channel of a heat exchanger according to an embodiment of the present disclosure.

FIG. 6 illustrates a detail view of an alignment feature positioned within the inner annular channel 62 of a heat exchanger according to another embodiment of the disclosure. An alignment feature that comprises a separate structure, such as one or more wires 66, may be positioned in one or more of the outer annular channel 64, between the elongated tube 30 and the elongated shaft 22, and the inner annular channel 62, between the elongated tube 30 and the heat pipe 16, to facilitate the coaxial alignment of the elongated tube 30 with the elongated shaft 22 and/or the heat pipe 16. For example, the wire 66 may be shaped generally as a helix and may be positioned in the outer annular channel 64 (see FIG. 5), between the elongated tube 30 and the elongated shaft 22, and a second wire 66 shaped generally as a helix may be positioned in the inner annular channel 62, between the elongated tube 30 and the heat pipe 16, to facilitate the coaxial alignment of the elongated tube 30 with the elongated shaft 22 and the heat pipe 16.

Figure 7:
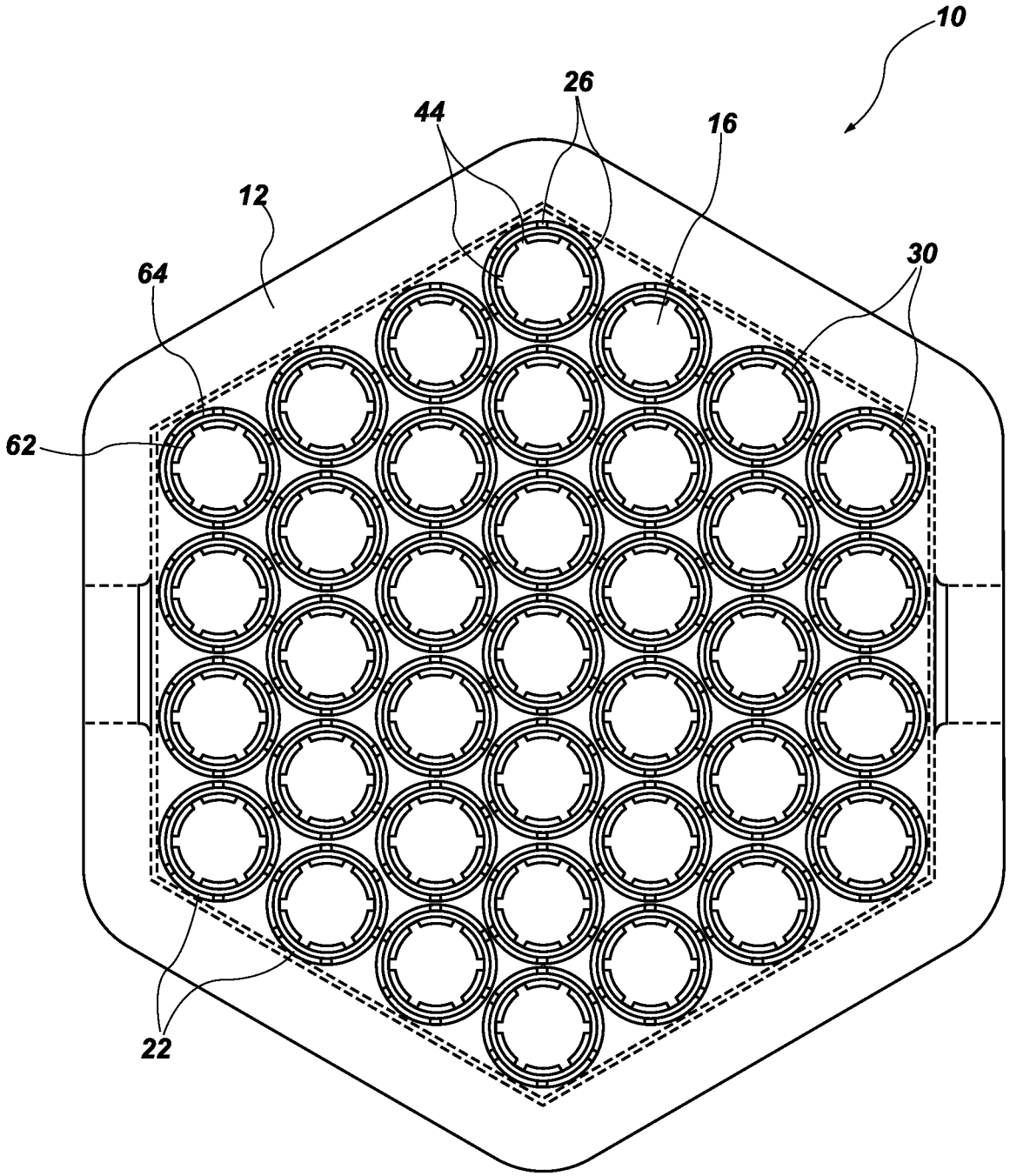
FIG. 7 illustrates a lateral cross-sectional detail view of the heat exchanger of FIG. 1.

Accordingly, for heat exchangers 10 including alignment features, such as the wires 66 and/or the pins 26, 44, the inner annular channels 62 and/or the outer annular channels 64 may have a lateral cross-section shaped generally as a segmented annulus (e.g., a segmented ring), such as shown in FIG. 7.

Alignment features, such as the wires 66 and/or the pins 26, 44, may provide benefits in addition to facilitating and maintaining the alignment of the elongated shafts 22, the elongated tubes 30, and the heat pipes 16. For example, alignment features may increase the heat transfer surface area between the second working fluid and the heat exchanger 10 and may promote enhanced heat transfer of the second working fluid, which may improve the performance of the heat exchanger 10.

Referring again to FIG. 1, in operation, heat may be provided to the second end 54 of each of the heat pipes 16 by a heat source, such as a nuclear reactor core of a nuclear micro-reactor. The heat source may heat the second end 54 (e.g., the evaporator end) of the heat pipes 16 to very high temperatures, such as in the range of from about 700° C. to about 800° C. Upon being heated, at least a portion of the first working fluid at the second end 54 of the heat pipes 16 will exceed its boiling temperature and change state from a liquid to a vapor The hot vaporized first working fluid may then travel along the annular open channel 42 (see FIG. 4A) toward the first end 52 (e.g., the condenser end) of the heat pipes 16, located within the main body 12 of the heat exchanger 10. Accordingly, the first end 52 of the heat pipes 16 may be provided heat from the heat source by the first working fluid within the heat pipes 16.

Meanwhile, the second working fluid may be directed into the inlet plenum 34 of the heat exchanger 10 via the one or more openings 48. As a non-limiting example, the second working fluid may be a nitrogen gas, helium gas, carbon dioxide gas, and/or air at a pressure of about 12 bar (about 1,200 kPa). As a further non-limiting example, the second working fluid may be directed into the inlet plenum 34 of the heat exchanger 10 at a temperature of about 360° C. and at a mass flow rate of about 0.281 kg/s. The second working fluid will then be directed through the openings 32 (see FIG. 3) in the manifold 28 and into the elongated tubes 30 extending therefrom. The second working fluid may first travel through the inner annular channel 62 (see FIG. 5) from the manifold 28 of the flow skirt 14 to the header 20 of the main body 12. As the second working fluid travels through the inner annular channel 62, the second working fluid will be adjacent to and in contact with the outer shell 38 of the first end 52 of the heat pipes 16 and will draw heat from the heat pipes 16.

Upon reaching the header 20 of the main body 12, the second working fluid will be directed into the outer annular channel 64 (see FIG. 5) and reverse its direction in the heat exchanger 10. The second working fluid may be directed through the outer annular channel 64 from the header 20 of the main body 12 toward the manifold 28 of the flow skirt 14 and into the outlet plenum 36. As the second working fluid travels through the outer annular channel 64, heat may be transferred between the second working fluid in the inner annular channel 62 and the second working fluid in the outer annular channel 64 via the elongated tubes 30 of the flow skirt 14. The heated second working fluid may then be directed from the outlet plenum 36 out of the heat exchanger 10 via the one or more openings 50. As a non-limiting example, the second working fluid may exit the heat exchanger 10 at a temperature of about 600° C. and the heat duty for the heat exchanger 10 may be about 71 kW.

As the second working fluid in the heat exchanger 10 extracts heat from the first end 52 of the heat pipes 16, at least a portion of the first working fluid at the first end 52 of the heat pipes 16 may cool to a temperature below the boiling temperature of the first working fluid and change phase from a vapor to a liquid. The first working fluid in liquid phase may be absorbed by the wicking material 40 (see FIG. 4A) and may be transported to the second end 54 of the heat pipe 16 by the wicking material 40 via capillary action.

Figure 8:
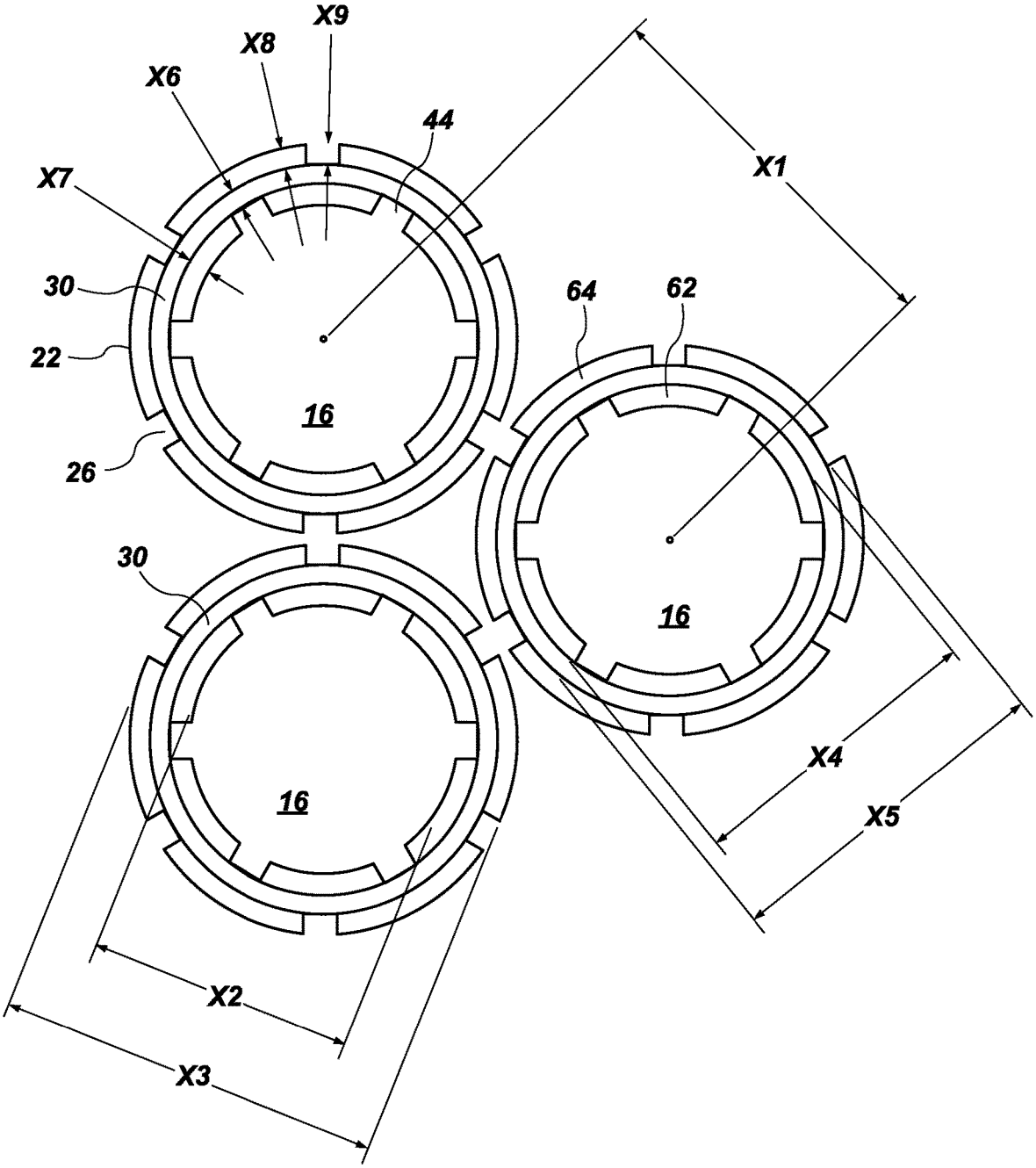
FIG. 8 illustrates a cross-sectional detail view of a portion of heat pipes positioned within corresponding tubes and elongated shafts according to an embodiment of the disclosure.

FIG. 8 illustrates a cross-sectional detail view of a portion of heat pipes 16 positioned within corresponding elongated tubes 30 and elongated shafts 22 according to an embodiment of the disclosure. Dimensions are provided herein as a non-limiting example, and additional embodiments of the present disclosure may be dimensioned differently. As shown, the pitch X1 (e.g., the spacing or the distance between a longitudinal axis of each) of the heat pipes 16 may be about 1.126 inches (about 28.6 mm). An outer diameter X2 of the heat pipes may be about 0.76 inches (about 19.3 mm) and a diameter X3 of the elongated shafts may be about 1.096 inches (about 27.84 mm). The elongated tubes 30 may have an inner diameter X4 of about 0.872 inches (about 22.1 mm) and an outer diameter X5 of about 0.984 inches (about 25 mm). Accordingly, a thickness X6 of the elongated tubes 30, a thickness X7 of the inner annular channels, and a thickness X8 of the outer annular channels may each be about 0.056 inches (about 1.42 mm), and any alignment features, such as the wires and/or pins, may have a width X9 of about 0.056 inches (about 1.42 mm) or less.

Referring again to FIG. 2A, the main body 12 of the heat exchanger 10 may be shaped generally as an extruded hexagon. The main body 12 may have an overall length X10 of about 39.4 inches (about 1 m), and a width X11 of about 10 inches (about 25.4 cm). Referring now to FIG. 1, the one or more openings 48 may have an inner diameter X12 of about 0.625 inches (about 15.9 mm) and the one or more openings 50 may have an inner diameter X13 of about 0.625 inches (about 15.9 mm). The inlet plenum 34 may have a height X14 of about 1.97 inches (about 50 mm) and the outlet plenum 36 may have a height X15 of about 1.97 inches (about 50 mm).

Figure 9:
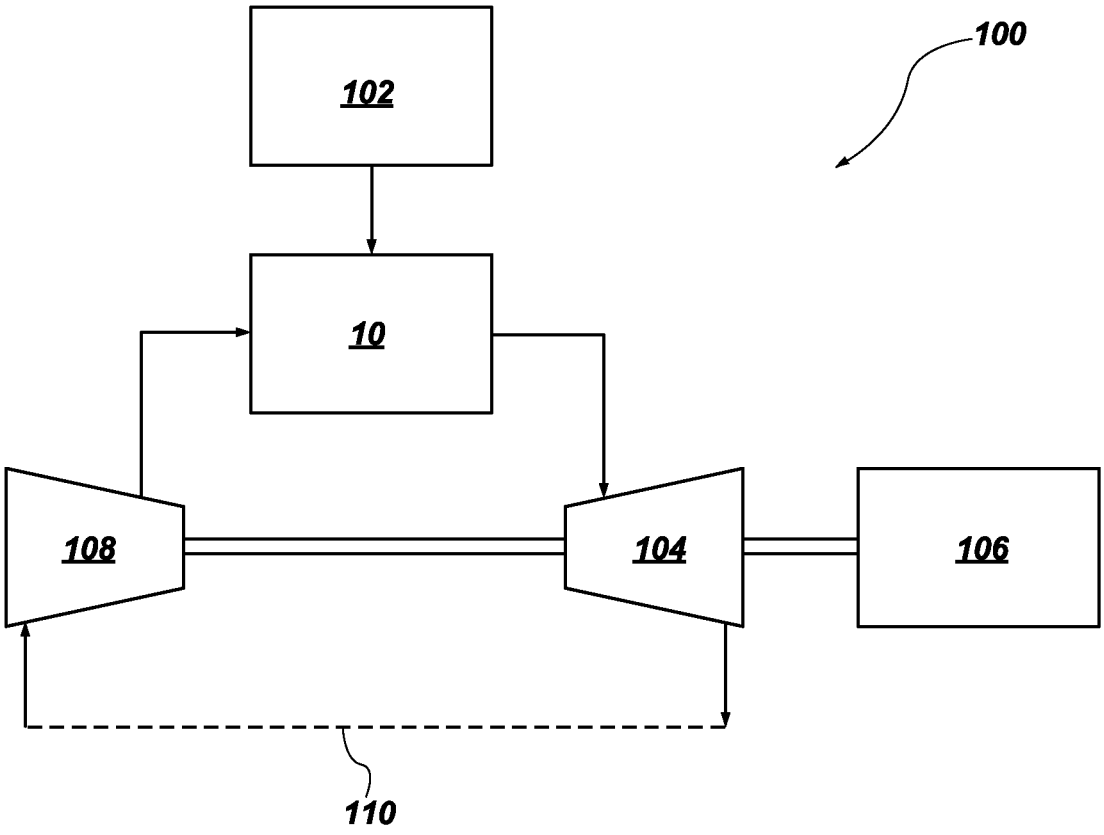
FIG. 9 illustrates a schematic diagram of a power system according to embodiments of the present disclosure.

FIG. 9 illustrates a schematic diagram of a power system 100 comprising a heat exchanger according to embodiments of the present disclosure. The power system 100 may include a heat source, such as a nuclear micro-reactor 102. The nuclear micro-reactor 102 may provide heat to a heat exchanger, such as the heat exchanger 10 described with reference to FIG. 1, via a plurality of heat pipes 16 (see FIG. 1). The heat exchanger 10 may extract heat from the heat pipes 16 with the second working fluid and the heated second working fluid may be directed into a power generator to provide work. For example, the heated second working fluid may be directed into a turbine 104. The second working fluid may be expanded in the turbine 104, thus rotating the turbine 104, and the second working fluid may exit the turbine 104 at a lower temperature and pressure. The turbine 104 may be coupled to an electric power generator 106, and work provided by the turbine 104 may be converted to electrical power by the electric power generator 106. Additionally, the turbine 104 may be coupled to a compressor 108 and provide work to operate the compressor 108.

The compressor 108 may compress and pressurize the second working fluid and direct the pressurized second working fluid into the heat exchanger 10. In some embodiments, the second working fluid may be recycled in a closed system, and the second working fluid exiting the turbine 104 may be directed into the compressor 108 (as indicated by dashed line 110). Accordingly, the power system 100 may operate according to a closed Brayton cycle. In additional embodiments, the second working fluid may be exhausted out of the turbine 104 into the ambient environment and ambient gases (e.g., ambient air), or gases from a gas source, may be drawn into the compressor 108 to be utilized as the second working fluid. Accordingly, the power system 100 may operate according to an open Brayton cycle.

The heat pipe-cooled nuclear micro-reactor core of the nuclear micro-reactor 102 may be operated at a relatively high temperature, such as above about 600° C. Meanwhile the second working fluid temperature entering the heat exchanger may be at a relatively low temperature, such as less than about 360° C. This large temperature difference can lead to significant thermal stresses on system components including the heat exchanger 10. Accordingly, heat exchangers 10 according to embodiments of the present disclosure are designed to reduce (e.g., minimize) temperature gradients within the heat exchanger 10 so as to prevent any structural failure due to thermal stress and/or thermal fatigue. Heat exchangers 10 according to embodiments of the disclosure may enable the high-pressure, high-temperature volumetrically efficient heat removal from the micro-reactor core that is needed for the integration of the reactor with a high-pressure power conversion cycle such as an air Brayton cycle or a supercritical $CO_2$ Brayton cycle.

While the disclosure is susceptible to various modifications and alternative forms, specific embodiments have been shown by way of example in the drawings and have been described in detail herein. However, the disclosure is not intended to be limited to the particular forms disclosed. Rather, the disclosure is to cover all modifications, equivalents, and alternatives falling within the scope of the disclosure as defined by the following appended claims and their legal equivalents.

What is claimed is:

1. A heat exchanger comprising:

a main body comprising an inlet plenum and an outlet plenum at a first end, a header at a second end, and at least one elongated shaft extending from the outlet plenum to the header;

at least one heat pipe coupled to the header of the main body, a portion of the at least one heat pipe positioned within the at least one elongated shaft of the main body defining an annular space between the at least one heat pipe and the at least one elongated shaft; and a flow skirt comprising a manifold located between the inlet plenum and the outlet plenum of the main body and at least one elongated tube extending from the manifold, the at least one elongated tube positioned within the annular space between the at least one heat pipe and the at least one elongated shaft, dividing the annular space into two concentric annular channels comprising an inner annular channel and an outer annular channel.

2. The heat exchanger of claim 1, wherein a longitudinal axis of the at least one elongated shaft, the at least one elongated tube, and the at least one heat pipe are at least substantially coaxially aligned.

3. The heat exchanger of claim 2, further comprising at least one alignment feature positioned in the outer annular channel, the at least one alignment feature sized and configured to maintain the coaxial alignment of the at least one elongated shaft and the at least one elongated tube.

4. The heat exchanger of claim 3, further comprising at least another alignment feature positioned in the inner annular channel, the at least another alignment feature sized and configured to maintain the coaxial alignment of the at least one elongated tube and the at least one heat pipe.

5. The heat exchanger of claim 4, wherein:

the at least one alignment feature comprises a plurality of pins positioned on a surface of at least one of the at least one elongated shaft and the at least one elongated tube, and the at least another alignment feature comprises a plurality of pins positioned on a surface of at least one of the at least one heat pipe and the at least one elongated tube.

6. The heat exchanger of claim 4, wherein each of the at least one alignment feature and the at least another alignment feature comprises a wire.

7. The heat exchanger of claim 6, wherein the wire is shaped generally as a helix.

8. The heat exchanger of claim 4, wherein the at least one alignment feature and the at least another alignment feature divide the inner annular channel into segmented inner annular channels and divide the outer annular channel into segmented outer annular channels.

9. The heat exchanger of claim 1, wherein the at least one elongated tube is spaced from the header of the main body, providing fluid communication between the inner annular channel and the outer annular channel.

10. A power system comprising:

a heat exchanger comprising:

a main body comprising an inlet plenum and an outlet plenum at a first end, a header at a second end, and at least one elongated shaft extending from the outlet plenum to the header;

at least one heat pipe coupled to the header of the main body and a portion of the at least one heat pipe positioned within the at least one elongated shaft of the main body defining an annular space between the at least one heat pipe and the at least one elongated shaft; and a flow skirt comprising a manifold located between the inlet plenum and the outlet plenum of the main body and at least one elongated tube extending from the manifold, the at least one elongated tube positioned within the annular space between the at least one heat pipe and the at least one elongated shaft, dividing the annular space into two concentric annular channels comprising an inner annular channel and an outer annular channel;

a heat source configured to deliver heat to the at least one heat pipe of the heat exchanger; and a power generator fluidly coupled to an outlet of the heat exchanger and configured to convert heat from the heat exchanger into work.

11. The power system of claim 10, wherein the heat source comprises a nuclear micro-reactor.

12. The power system of claim 10, wherein the power generator comprises a turbine.

13. The power system of claim 12, further comprising an electric power generator coupled to the turbine.

14. The power system of claim 13, further comprising a compressor fluidly coupled to an inlet of the heat exchanger.

15. The power system of claim 14, wherein an outlet of the turbine is fluidly coupled to an inlet of the compressor.

* * * * *